US012698918B2

(12) United States Patent
Liu et al.

(10) Patent No.: US 12,698,918 B2
(45) Date of Patent: Aug. 4, 2026

(54) MULTI-SPLIT AIR CONDITIONER, AND METHOD AND DEVICE FOR CONTROLLING MULTI-SPLIT AIR CONDITIONER

(71) Applicants: QINGDAO HAIER AIR-CONDITIONING ELECTRONIC CO., LTD, Qingdao (CN); QINGDAO HAIER AIR CONDITIONER GENERAL CORP., LTD., Qingdao (CN); HAIER SMART HOME CO.,LTD, Qingdao (CN)

(72) Inventors: Donglai Liu, Qingdao (CN); Yizhong Yuan, Qingdao (CN); Dahai Lu, Qingdao (CN); Shoubo Mao, Qingdao (CN)

(73) Assignees: QINGDAO HAIER AIR-CONDITIONING ELECTRONIC CO., LTD, Qingdao (CN); QINGDAO HAIER AIR CONDITIONER GENERAL CORP., LTD., Qingdao (CN); HAIER SMART HOME CO., LTD, Qingdao (CN)

( * ) Notice: Subject to any disclaimer, the term of this patent is extended or adjusted under 35 U.S.C. 154(b) by 289 days.

(21) Appl. No.: 18/700,026

(22) PCT Filed: Nov. 17, 2022

(86) PCT No.: PCT/CN2022/132550
§ 371 (c)(1),
(2) Date: Apr. 10, 2024

(87) PCT Pub. No.: WO2023/207040
PCT Pub. Date: Nov. 2, 2023

(65) Prior Publication Data
US 2024/0337407 A1 Oct. 10, 2024

(30) Foreign Application Priority Data
Apr. 26, 2022 (CN) ..... 202210445855.X

(51) Int. Cl.
*F24F 11/84* (2018.01)
*F24F 11/64* (2018.01)
*F24F 11/65* (2018.01)

(52) U.S. Cl.
CPC ..... *F24F 11/84* (2018.01); *F24F 11/64* (2018.01); *F24F 11/65* (2018.01)

(58) Field of Classification Search
CPC ..... F24F 11/84; F24F 11/64; F24F 11/65
See application file for complete search history.

(56) References Cited

U.S. PATENT DOCUMENTS 11,732,939 B2 * 8/2023 Zhai ..... F24F 11/36 702/51
2005/0081543 A1 4/2005 Oh et al.
(Continued)

FOREIGN PATENT DOCUMENTS

CN 102003773 A 4/2011
CN 102635926 A 8/2012
(Continued)

OTHER PUBLICATIONS

Extended European Search Report issued in counterpart European Patent Application No. 22939855.7, dated Mar. 4, 2025.
(Continued)

*Primary Examiner* — Nael N Babaa
(74) *Attorney, Agent, or Firm* — Westbridge IP LLC

(57) ABSTRACT

A multi-split air conditioner comprising an outdoor unit and a group of indoor units, the group of indoor units comprising a plurality of indoor units connected in parallel, at least one indoor unit comprising: a main flow path, comprising an electronic expansion valve and an indoor heat exchanger
(Continued)

successively connected via a main pipeline, at least part of the main pipeline located at a refrigerant inlet end of the electronic expansion valve being used as a supercooling parallel section; a supercooling branch, comprising a supercooler, the supercooling branch being connected in parallel to the supercooling parallel section; and a communication switching assembly, configured to be controlled to communicate the supercooling parallel section and/or the supercooling branch with the electronic expansion valve.

16 Claims, 5 Drawing Sheets

(56) References Cited

U.S. PATENT DOCUMENTS

| | | | |
|---|---|---|---|
| 2005/0160763 | A1 | 7/2005 | Choi et al. |
| 2014/0266755 | A1 | 9/2014 | Arensmeier et al. |

FOREIGN PATENT DOCUMENTS

| | | | |
|---|---|---|---|
| CN | 102734865 | A | 10/2012 |
| CN | 111023272 | A | 4/2020 |
| CN | 111397239 | A | 7/2020 |
| CN | 111845821 | A | 10/2020 |
| CN | 112833473 | A | 5/2021 |
| CN | 215295159 | U | 12/2021 |
| KR | 20120084528 | A | 7/2012 |

OTHER PUBLICATIONS

International Search Report issued in corresponding PCT Application No. PCT/CN2022/132550, dated Feb. 10, 2023.

First Office Action issued in counterpart Chinese Patent Application No. 202210445855.X, dated Dec. 17, 2025.

* cited by examiner

MULTI-SPLIT AIR CONDITIONER, AND METHOD AND DEVICE FOR CONTROLLING MULTI-SPLIT AIR CONDITIONER

CROSS-REFERENCE TO RELATED APPLICATIONS

This application is the National Stage of International Application No. PCT/CN2022/132550, filed on Nov. 17, 2022, which claims priority to Chinese Patent Application No. 202210445855.X, filed on Apr. 26, 2022. All of the aforementioned applications are incorporated herein by reference in their entireties.

TECHNICAL FIELD

The disclosure relates to the multi-split air conditioner, particularly to a multi-split air conditioner, a method and a device for controlling the multi-split air conditioner.

BACKGROUND

The multi-split air conditioner comprises a plurality of indoor units used in parallel, and each indoor unit comprises an indoor heat exchanger and an electronic expansion valve. In the cooling operation mode, when the high-pressure liquid refrigerant enters the indoor unit and flows through the electronic expansion valve, there is a problem that the subcooling degree before the electronic expansion valve is insufficient, that is, the refrigerant before the valve is in a gas-liquid two-phase state, so the refrigerant throttling sound is extremely obvious. Especially for multi-split air conditioners installed with long pipes and large falling heads, even if the subcooling degree of refrigerant output from the outdoor unit is large enough, after entering indoor units, due to factors such as pipeline pressure loss and heat loss, it is easy to have an insufficient subcooling degree before electronic expansion valve of indoor units, resulting in throttling noise. This problem has always been the main problem of user complaints.

In the related arts, the subcooling degree at the outlet of the liquid pipe is increased by adding secondary subcooling equipment such as plate replacement and double pipe to the outdoor unit, so as to ensure that there is a certain subcooling degree before the refrigerant reaches the electronic expansion valve on the user side, thus solving the throttling sound problem to a certain extent. In the process of implementing the embodiment of the present disclosure, it is found that at least the following problems exist in the related arts:

Because the installation environment of indoor units of the multi-split air conditioners is not the same, even if the refrigerant on the outdoor side has a large subcooling degree, it cannot guarantee that the subcooling degree before the valve of each indoor unit meets the requirements, so the there is little improvement on abnormal throttling sound.

SUMMARY

In order to have a basic understanding of some aspects of the disclosed embodiments a brief summary is given below. The summary is not intended to be a general comment to identify key/important constituent elements or to describe the scope of protection of these embodiments but rather to serve as a preface to the detailed description that follows.

The embodiment of the disclosure provides a multi-split air conditioner, a method, and a device for controlling the multi-split air conditioner, so as to improve the abnormal throttle sound on the indoor side of the multi-split air conditioner.

In some embodiments, the multi-split air conditioner comprises an outdoor unit and an indoor unit group, the indoor unit group comprising a plurality of indoor units connected in parallel. At least one indoor unit comprises a main flow path comprising an electronic expansion valve and an indoor heat exchanger connected sequentially through a main pipeline, where at least part of the main pipeline located at a refrigerant inlet end of the electronic expansion valve is defined as a subcooling parallel section, a subcooling branch comprising a subcooler, where the subcooling branch is connected in parallel with the subcooling parallel section, and a switching connection assembly configured to be controlled to connect the subcooling parallel section and/or the subcooling branch to the electronic expansion valve.

Optionally, the subcooler is disposed at a wind area of an air outlet side of the indoor heat exchanger.

Optionally, the indoor unit further comprises: a main air duct provided with the indoor heat exchanger and a subcooling air duct disposed at a downstream air path of the main air duct and connected in parallel with the main air duct, where the subcooler is disposed in the subcooling air duct, and an air inlet of the subcooling air duct is further provided with a damper configured to be controlled to adjust an opening degree to change the air flow rate flowing through the subcooling air duct from the main air duct.

Optionally, the switching connection assembly comprises: a first solenoid valve disposed on the subcooling parallel section and a second solenoid valve disposed on the subcooling branch.

In some embodiments, the method for controlling a multi-split air conditioner comprises: in response to a cooling mode operation command, obtaining a current first subcooling degree at a refrigerant inlet end of an electronic expansion valve; in a case where the current first subcooling degree is less than or equal to the first preset subcooling degree, controlling a switching connection assembly to connect a subcooling branch to the electronic expansion valve.

Optionally, the step of obtaining a current first subcooling degree at the refrigerant inlet end of the electronic expansion valve comprises:

according to a difference between a current condensation temperature of the outdoor unit and a first refrigerant temperature at the refrigerant inlet end of the electronic expansion valve, determining the current first subcooling degree.

Optionally, the current first subcooling degree is obtained by:

$$SC_{j1} = k \times TC - T_{1,j1}$$

where $SC_{j1}$ is the current first subcooling degree, TC is the current condensation temperature, $T_{1,j1}$ is the first refrigerant temperature, k is a subcooling correction parameter, and $k<1$.

Optionally, the step of controlling the switching connection assembly to connect the subcooling branch to the electronic expansion valve comprises:

controlling the switching connection assembly to connect the subcooling branch to the electronic expansion valve and to disconnect the subcooling parallel section from the electronic expansion valve; or controlling the switching connection assembly to connect the subcooling branch and the subcooling parallel section to the electronic expansion valve.

Optionally, in a case where the indoor unit comprises a main air duct and a subcooling air duct, after the step of connecting the subcooling branch to the electronic expansion valve, the method further comprises:

obtaining a second refrigerant temperature at an outlet end of the subcooling branch;

according to a difference between the current condensation temperature of the outdoor unit and a second refrigerant temperature, determining the current first subcooling degree at the refrigerant inlet end of the electronic expansion valve; and according to the preset subcooling degree range where the current second subcooling degree is located, controlling the air flow rate from the main air duct to the subcooling air duct.

Optionally, the current second subcooling degree is obtained by:

$$SC_{j2} = k \times TC - T_{l,j2}$$

where $SC_{j2}$ is the current second subcooling degree, TC is the current condensation temperature, $T_{1,j2}$ is the second refrigerant temperature, k is a subcooling correction parameter, and k<1.

Optionally, the method further comprises: in a case where the current second subcooling degree is less than or equal to the first preset subcooling degree, controlling the air flow rate from the main air duct to the subcooling air duct to increase;

in a case where the current second subcooling degree is greater than the second preset subcooling degree, controlling the air flow rate from the main air duct to the subcooling air duct to decrease;

in a case where the current second subcooling degree is greater than the first preset subcooling degree and less than or equal to the second preset subcooling degree, controlling the air flow rate from the main air duct to the subcooling air duct to remain unchanged.

Optionally, a damper is provided on the subcooling air duct, for controlling the opening degree to change the air flow rate flowing through the subcooling air duct from the main air duct, and the step of controlling the air flow rate from the main air duct to the subcooling air duct to increase comprises:

according to a difference between the current second subcooling degree and the first preset subcooling degree, controlling the damper to rotate in the direction of increasing the opening degree, so as to increase the air flow rate from the main air duct to the subcooling air duct; or the step of controlling the air flow rate from the main air duct to the subcooling air duct to decrease comprises:

according to the difference between the current second subcooling degree and the second preset subcooling degree, controlling the damper to rotate in the direction of decreasing the opening degree, so as to decrease the air flow rate from the main air duct to the subcooling air duct.

Optionally, the method further comprises: in a case where an outdoor environment temperature is greater than the preset temperature, obtaining the current first subcooling degree at the refrigerant inlet end of the electronic expansion valve; and in a case where the outdoor environment temperature is less than or equal to the preset temperature, controlling the switching connection assembly to disconnect the subcooling branch from the electronic expansion valve.

In some embodiments, the device for controlling a multi-split air conditioner comprises: an acquisition module configured to, in response to a cooling mode operation command, obtain a current first subcooling degree at a refrigerant inlet end of an electronic expansion valve; and a control module configured to, in a case where the current first subcooling degree is less than or equal to a first preset subcooling degree, control a switching connection assembly to connect a subcooling branch with the electronic expansion valve.

In other embodiments, the device for controlling a multi-split air conditioner comprises a processor and a memory storing program instructions, and the processor is configured to execute the method for controlling the multi-split air conditioner described above when the program instructions are running.

The multi-split air conditioner, the method, and the device for controlling the multi-split air conditioner provided by the embodiment of the disclosure can achieve the following technical effects:

with a subcooling parallel section before the refrigerant inlet end of the electronic expansion valve of the indoor unit of the multi-split air conditioner and a subcooling branch disposed in parallel with the subcooling parallel section, part or all of the refrigerant flow in the main flow path of the indoor unit enters the refrigerant inlet end of the electronic expansion valve after passing through the subcooling branch by the switching connection assembly, thereby improving the subcooling degree before the electronic expansion valve, making the refrigerant in the throttling process more stable, and achieving the purpose of improving the abnormal throttling sound on the indoor side of the multi-split air conditioner.

The above general description and the description below are exemplary and explanatory only and are not intended to limit the present disclosure.

BRIEF DESCRIPTION OF THE DRAWINGS

One or more embodiments are illustrated by means of the corresponding drawings, which do not constitute a limitation of the embodiments, elements having the same reference numeral numerals in the drawings are shown as like elements, the drawings do not constitute a limitation of proportion, and in the drawings.

DETAILED DESCRIPTION OF THE EMBODIMENTS

In order to enable a more detailed understanding of the features and technical content of the embodiments of the present disclosure, the implementation of the embodiments of the present disclosure will be described in detail below in conjunction with the accompanying drawings, which are for illustration only and are not intended to limit the embodiments of the present disclosure. In the following technical description for convenience of explanation, a number of details are passed to provide a full understanding of the disclosed embodiments. However, one or more embodiments may still be practiced without these details. In other instances, well-known structures and apparatuses may simplify in presentation to simplify the drawings.

The terms "first", "second" and the like in the specification and claims of embodiments of the present disclosure and the above drawings are used to distinguish similar objects and are not necessarily used to describe a particular order or priority. It should be understood that the data used in this way can be interchanged where appropriate for the embodiments of the present disclosure described herein. Furthermore, the terms "comprise" and "have" and any variations thereof are intended to cover non-exclusive inclusion.

Unless otherwise stated, the term "a plurality of" means two or more.

In the embodiment of the present disclosure, the character "/" indicates that the front and back objects are an "or" relationship. For example, A/B stands for A or B.

The term "and/or" is an association relationship that describes objects, indicating that there can be three relationships. For example, A and/or B represent three relationships: A or B, or A and B.

The term "corresponding" can refer to an association or binding relationship, and the correspondence between A and B means that there is an association or binding relationship between A and B.

Figure 1:
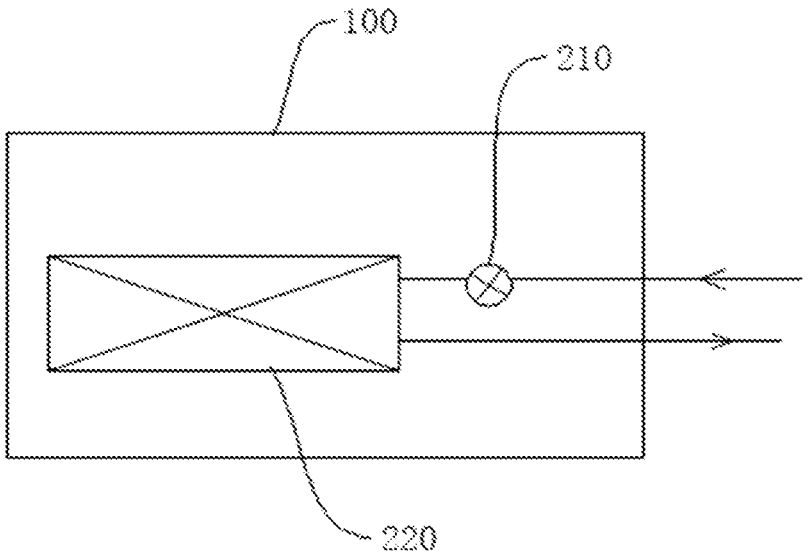
FIG. 1 is a schematic diagram of the connection structure of a multi-split air conditioner indoor unit in the related art.

FIG. 1 is a schematic diagram of the connection structure of a multi-split air conditioner indoor unit in the related art.

As shown in FIG. 1, the refrigerant circulation path of the multi-split air conditioner indoor unit 100 comprises a main liquid pipe, an electronic expansion valve 210, an indoor heat exchanger 220, and a main gas pipe (described with the refrigerant flow direction in the cooling mode as an example). In order to realize the air conditioning function, the temperature of the refrigerant at different positions of the refrigerant circulation path and the environment temperature can further be obtained through the temperature sensors.

In the cooling mode, the high-temperature and high-pressure refrigerant output from the outdoor unit directly flows into the indoor unit 100 through the main liquid pipe, and then is throttled through the electronic expansion valve 210 to become the low-temperature and low-pressure two-phase refrigerant, which has evaporation heat exchange in the indoor heat exchanger, and after heat exchange with indoor air, the cooled air is sent to the indoor.

In this way, due to the difference in refrigerant state before the electronic expansion valve (such as insufficient subcooling, or gas-liquid two-phase flow, etc.), the throttling sound of such refrigerant in the closure process will be loud, and usually "sniff" sound will appear, which will be extremely obvious when the indoor background sound is quiet.

Therefore, this disclosure provides a new form of multi-split air conditioner to improve the throttle sound with structural improvement and control strategy.

Figure 2:
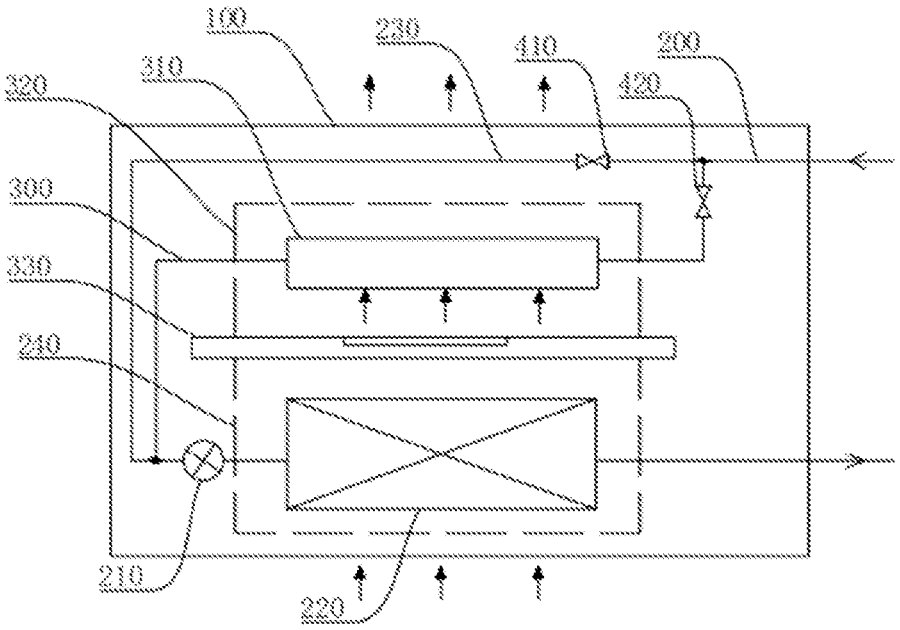
FIG. 2 is a connection schematic diagram of an indoor unit of a multi-split air conditioner provided by the embodiment of the present disclosure.
Figure 3:
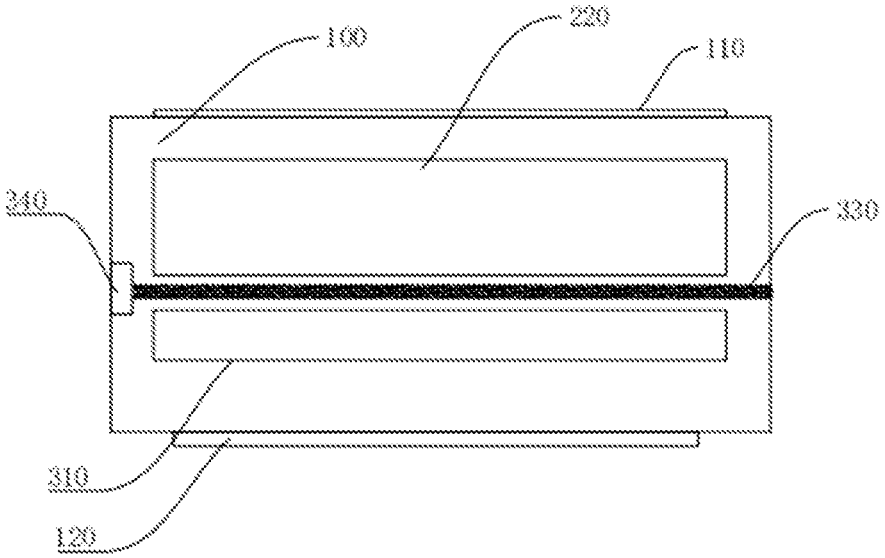
FIG. 3 is a connection schematic diagram of an indoor unit of a multi-split air conditioner provided by the embodiment of the present disclosure.
Figure 4:
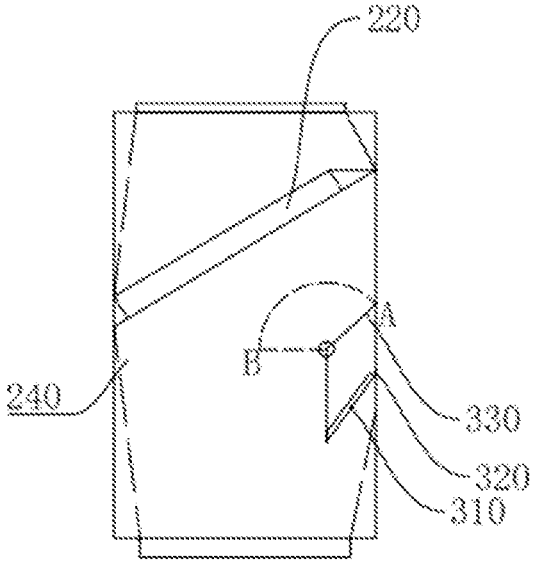
FIG. 4 is a cross-sectional view of the indoor unit shown in FIG. 3.

FIG. 2 is a connection schematic diagram of an indoor unit of a multi-split air conditioner provided by the embodiment of the present disclosure. FIG. 3 is a connection schematic diagram of an indoor unit of a multi-split air conditioner provided by the embodiment of the present disclosure. FIG. 4 is a cross-sectional view of the indoor unit shown in FIG. 3.

With reference to FIGS. 2 to 4, the embodiment of the present disclosure provides a multi-split air conditioner comprising an outdoor unit and an indoor unit group, the indoor unit group comprising a plurality of indoor units 100 connected in parallel. At least one indoor unit 100 of the multi-split air conditioner comprises:

- a main flow path 200 comprising an electronic expansion valve 210 and an indoor heat exchanger 220 sequentially connected through a main pipeline. At least part of the main pipeline located at a refrigerant inlet end of the electronic expansion valve 210 is defined as the subcooling parallel section 230;
- a subcooling branch 300 comprising a subcooler 310 connected in parallel with the subcooling parallel section 230; and
- a switching connection assembly configured to be controlled to connect the subcooling parallel section 230 and/or the subcooling branch 300 to the electronic expansion valve 210.

Generally, a multi-split air conditioner comprises one or more outdoor units and a plurality of indoor units. A plurality of indoor units are disposed in parallel and connected to the outdoor unit through corresponding pipes, thereby realizing the flow of refrigerant. In the embodiment, one of the indoor units in a multi-split air conditioner is taken as an example to explain the disclosure. The structure diagram of the outdoor unit is not shown. One skilled in the art can realize the connection between the indoor unit and the outdoor unit for the indoor unit provided by the embodiment, thereby forming the refrigerant circulation path of the multi-split air conditioner. In other embodiments, the multi-split air conditioner may comprise one or more indoor units of the present embodiment.

Herein, with a subcooling parallel section before the refrigerant inlet end of the electronic expansion valve of the indoor unit of the multi-split air conditioner and a subcooling branch disposed in parallel with the subcooling parallel section, part or all of the refrigerant flow in the main flow path of the indoor unit enters the refrigerant inlet end of the electronic expansion valve after passing through the subcooling branch by the switching connection assembly, thereby improving the subcooling degree before the electronic expansion valve, making the refrigerant in the throttling process more stable, and achieving the purpose of improving the abnormal throttling sound on the indoor side of the multi-split air conditioner.

Optionally, the indoor heat exchanger 220 has an air inlet side and an air outlet side. The subcooler 310 is provided in a wind area on the outlet side of the indoor heat exchanger 220.

In the cooling mode, when the indoor heat exchanger exchanges heat with the air, as shown in the arrow direction in FIG. 2, the air at the inlet side moves to the outlet side, and the air at the outlet side has relatively lower temperature after heat exchange. In this way, by arranging the subcooler in the wind area, part of the cold air from the air outlet side of the indoor heat exchanger can be led to the subcooler, thus achieving the purpose of increasing the subcooling degree of the refrigerant in the subcooler 310. Similarly, the cooling capacity of flowing refrigerant per unit mass is increased, due to the subcooling degree is increased, so the "cooling capacity loss" caused by introducing this part of cold air into the subcooler is compensated.

Herein, the subcooler 310 may be a regenerator or a heat exchanger, such as a heat exchanger in the form of a single row of finned tubes with large fin spacing. Then, as the subcooler is mounted on the air outlet side of the indoor heat exchanger, the structural design will not increase the air resistance and has little influence on the air outlet of normal air conditioning of the air conditioner.

Further, the indoor unit 100 further comprises a main air duct 240 and a subcooling air duct 320.

The main air duct 240 is provided with an indoor heat exchanger 220. The subcooling air duct 320 is disposed in a downstream air path of the main air duct 240 and connected in series with the main air duct 240, and the subcooler 310 is disposed in the subcooling air duct 320. The air inlet of the subcooling air duct 320 is further provided with a damper 330 configured to control the opening degree to change the air flow rate flowing through the main air duct 240 to the subcooling air duct 320.

Herein, the airflow in the subcooling air duct is part of the airflow led out from the main air duct under the action of the damper. The air outlet of the subcooling air duct is connected to the main air duct, that is, the airflow of the subcooling air duct is discharged from the indoor unit through the main air duct after heat exchange with the subcooler. The opening degree of the damper can be adjusted according to the subcooling degree of the refrigerant output by the subcooler, so as to ensure the constant subcooling degree of the refrigerant before the valve, make the throttling process more stable and improve the throttling sound.

With reference to FIG. 3 and FIG. 4, how to adjust the airflow from the main air duct to the subcooling air duct via the damper is explained.

The indoor unit 100 comprises an air inlet 110 and an air outlet 120. The indoor air enters the main air duct 240 from the air inlet 110 to exchange heat with the indoor heat exchanger 220. The cooled air after heat exchange enters the room through the air outlet 120.

Driven by the stepper motor 340, the damper 330 can rotate between position A and position B in the subcooling air duct 320. In a case where the damper 330 is at position A, the subcooling air duct 320 is not connected to the main air duct 240, and air cannot enter the subcooling air duct 320. In a case where the damper 330 is at position B, the air flow rate from the main air duct 240 to the subcooling air duct 320 is the maximum. Therefore, by adjusting the opening degree of the damper 330, it is possible to change the air flow rate from the main air duct 240 to the subcooling air duct 320.

In the embodiment, the direction in which the opening degree of the damper 330 is adjusted from the position A to the position B is defined as an adjustment direction of opening degree for increasing the air flow rate, and the direction from the position B to the position A is defined as an adjustment direction of opening degree for decreasing the air flow rate.

Optionally, the switching connection assembly comprises: a first solenoid valve 410 disposed on the subcooling parallel section 230 and a second solenoid valve 420 disposed on the subcooling branch 300. In this way, the first solenoid valve 410 is controlled to turn on to make the subcooling parallel section 230 be connected to the electronic expansion valve 210, and the second solenoid valve 420 is controlled to turn on to make the subcooling branch 300 to be connected to the electronic expansion valve 210.

In addition, the switching connection assembly can further be a three-way valve. The three-way valve is disposed at the inlet end of the subcooling branch 300 in parallel with the subcooling parallel section 230, the inlet end of which is connected to the main flow path 200, the first outlet end of which is connected to the subcooling parallel section 230, and the second outlet end of which is connected to the subcooling branch 300. Thus, the inlet end and the first outlet end are controlled to communicate to make the subcooling parallel section 230 to be connected to the electronic expansion valve 210, and the inlet end and the second outlet end are controlled to communicate to make the subcooling branch 300 to be connected to the electronic expansion valve 210.

With reference to the different states of switching connection assembly described as following, the refrigerant flow direction in the indoor unit of the multi-split air conditioner in cooling operation mode is explained.

In a case where the switching connection assembly is switched to make the subcooling parallel section 230 connected to the electronic expansion valve 210 and the subcooling branch 300 is disconnected from the electronic expansion valve 210, that is the first solenoid valve 410 is turned on and the second solenoid valve 420 is turned off, after passing through the main flow path 200, the refrigerant input from the outdoor unit enters the electronic expansion valve 210 from the subcooling parallel section 230 for throttling. After throttling, the refrigerant enters the indoor heat exchanger 220 for evaporation heat exchange, and after heat exchange with indoor air, the refrigerant flows out of the indoor unit 100.

In a case where the switching connection assembly is switched to make the subcooling parallel section 230 disconnected from the electronic expansion valve 210 and the subcooling branch 300 connected to the electronic expansion valve 210, that is the first solenoid valve 410 is turned off and the second solenoid valve 420 is turned on, the refrigerant input from the outdoor unit enters through the main flow path 200 and is input into the subcooling branch path 300. At this time, the refrigerant is subcooled in the subcooling branch path 300, and the refrigerant with the increased subcooling degree enters the electronic expansion valve 210 for throttling. After throttling, the refrigerant enters the indoor heat exchanger 220 for evaporation heat exchange, and after heat exchange with indoor air, the refrigerant flows out of the indoor unit 100.

In a case where the communication assembly is switched to make the subcooling parallel section 230 connected to the electronic expansion valve 210 and the subcooling branch 300 connected to the electronic expansion valve 210, that is the first solenoid valve 410 is turned on and the second solenoid valve 420 is turned on, after passing through the main flow path 200, a part of the refrigerant input from the outdoor unit enters the subcooling parallel section 230 and the other part enters the subcooling branch path 300 for subcooling adjustment. After that, the two parts of refrigerant are jointly input into the electronic expansion valve 210 for throttling. After throttling, the refrigerant enters the indoor heat exchanger 220 for evaporation heat exchange, and after heat exchange with indoor air, the refrigerant flows out of the indoor unit 100.

Thus, with the subcooling parallel section before the refrigerant inlet end of the electronic expansion valve of the indoor unit of the multi-split air conditioner and the subcooling branch disposed in parallel with the subcooling parallel section, part or all of the refrigerant flow in the main flow path of the indoor unit enters the refrigerant inlet end of the electronic expansion valve after passing through the subcooling branch by the switching connection assembly, thereby improving the subcooling degree before the electronic expansion valve, making the refrigerant in the throttling process more stable, and achieving the purpose of improving the abnormal throttling sound on the indoor side of the multi-split air conditioner.

Figure 5:
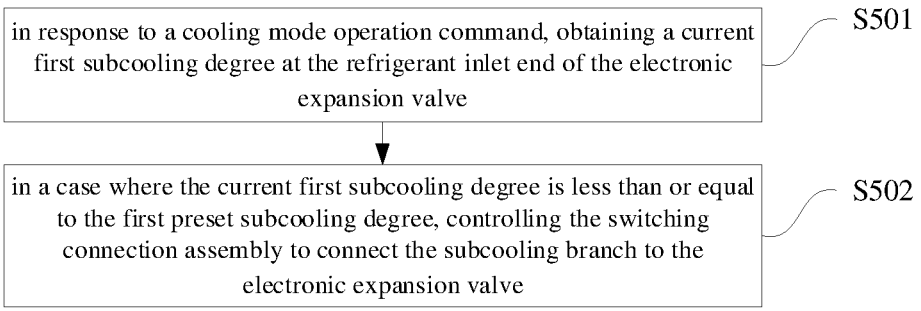
FIG. 5 is a flow chart of a method for controlling the multi-split air conditioner provided by the embodiment of the present disclosure.

FIG. 5 is a flow chart of a method for controlling the multi-split air conditioner provided by an embodiment of the present disclosure, which is adapted to the multi-split air conditioner shown in FIG. 2. The method can be executed by a processor of the multi-split air conditioner or in a cloud server communicated with the multi-split air conditioner. It can further be executed at the control terminal of the multi-split air conditioner. In the embodiment, the disclosure is explained by taking the processor of the multi-split air conditioner as the executive subject.

As shown in FIG. 5, the method for controlling the multi-split air conditioner comprises:

S501, in response to a cooling mode operation command, obtaining a current first subcooling degree at the refrigerant inlet end of the electronic expansion valve.

The current first subcooling degree refers to the subcooling degree before the electronic expansion valve at the current time, in a case where the refrigerant enters the electronic expansion valve through the subcooling parallel section.

Generally, in the cooling mode, the subcooling parallel section of the indoor unit is connected to the electronic expansion valve, the subcooling branch is disconnected from the electronic expansion valve, and the refrigerant enters the electronic expansion valve from the main flow path through the subcooling parallel section for throttling. That is, the first solenoid valve is turned on and the second solenoid valve is turned off.

S502, in a case where the current first subcooling degree is less than or equal to the first preset subcooling degree, controlling the switching connection assembly to connect the subcooling branch to the electronic expansion valve.

The first preset subcooling degree $n_1$ is employed to indicate that the current subcooling degree is small, and there will be noise problems when the refrigerant flows through the electronic expansion valve, so the subcooling degree needs to be increased.

The current first subcooling degree $SC_{j1}$ is less than or equal to $n_1$, which shows that the subcooling degree before the valve of the electronic expansion valve is low, and abnormal throttling sounds may occur. Therefore, by connecting the subcooling branch with the electronic expansion valve, part or all refrigerant enters the electronic expansion valve after passing through the subcooling branch for throttling. Because the subcooling branch improves the subcooling degree of the part or all refrigerant, the subcooling degree before the electronic expansion valve is adjusted, thus improving the abnormal throttling sound problem.

Herein, controlling the switching connection assembly to connect the subcooling branch to the electronic expansion valve can comprise two situations. Only the subcooling branch connected to the electronic expansion valve, and the subcooling parallel section disconnected from the electronic expansion valve, all refrigerant enters the electronic expansion valve after passing through the subcooling branch. Or, the subcooling branch and the subcooling parallel section are both connected to the electronic expansion valve, a part of the refrigerant enters the subcooling parallel section and a part of the refrigerant enters the subcooling branch to adjust the subcooling degree, and after that, two parts of refrigerant are jointly input into the electronic expansion valve for throttling.

Optionally, according to the difference range where the absolute value of the difference between $SC_{j1}$ and $n_1$ is located, the connecting state of the switching connection assembly is controlled.

Specifically, in a case where the absolute value of the difference between $SC_{j1}$ and $n_1$ is larger than the first difference value, the connecting state of the switching connection assembly is controlled to be that only the subcooling branch is connected to the electronic expansion valve, and the subcooling parallel section is disconnected from the electronic expansion valve, so as to greatly improve the subcooling degree of the refrigerant. In a case where the absolute value of the difference between $SC_{j1}$ and $n_1$ is less than the first difference value, the connecting state of the switching connection assembly is controlled to be that the subcooling branch and the subcooling parallel section are both connected to the electronic expansion valve, so that the problem of abnormal throttling sound is improved by adjusting the subcooling degree of part of refrigerant.

Further, in a case where the absolute value of the difference between $SC_{j1}$ and $n_1$ is smaller than the first difference, the proportion of the refrigerant entering the subcooling branch and the subcooling parallel section can be adjusted according to the proportion adjustment range where the absolute value of the difference between $SC_{j1}$ and $n_1$ is located. The corresponding relationship between the absolute value of the difference between $SC_{j1}$ and $n_1$ and the refrigerant proportion adjustment range can be obtained by experiments. After obtaining the absolute value of the current difference value, the current proportional adjustment range corresponding to the absolute value of the current difference value can be obtained by inquiring the database, so as to adjust the proportion of refrigerant entering the subcooling branch and the subcooling parallel section according to the current proportional adjustment range. The proportion of refrigerant entering the subcooling branch and the subcooling parallel section can be adjusted by adjusting the opening degree of the switching connection assembly.

Optionally, the step of obtaining the current first subcooling degree at the refrigerant inlet end of the electronic expansion valve comprises:

according to a difference between a current condensation temperature of the outdoor unit and a first refrigerant temperature at the refrigerant inlet end of the electronic expansion valve, determining the current first subcooling degree.

Herein, the current condensation temperature can be converted from the current refrigerant pressure at the outlet of the condenser of the outdoor unit, according to the corresponding relationship between temperature and saturation pressure, thus obtaining the current condensation temperature TC of the outdoor unit.

Optionally, the subcooling degree may be reduced by the flow of refrigerant in the pipes due to the resistance loss and heat loss of the pipeline extension, so it is necessary to correct the current refrigerant pressure via the subcooling correction parameter.

Then, the current first subcooling degree can be obtained as follows:

$$SC_{j1} = k \times TC - T_{1,j1}$$

where $SC_{j1}$ is the current first subcooling degree, TC is the current condensation temperature, $T_{1,j1}$ is the first refrigerant temperature, k is a subcooling correction parameter, and k<1.

Figure 6:
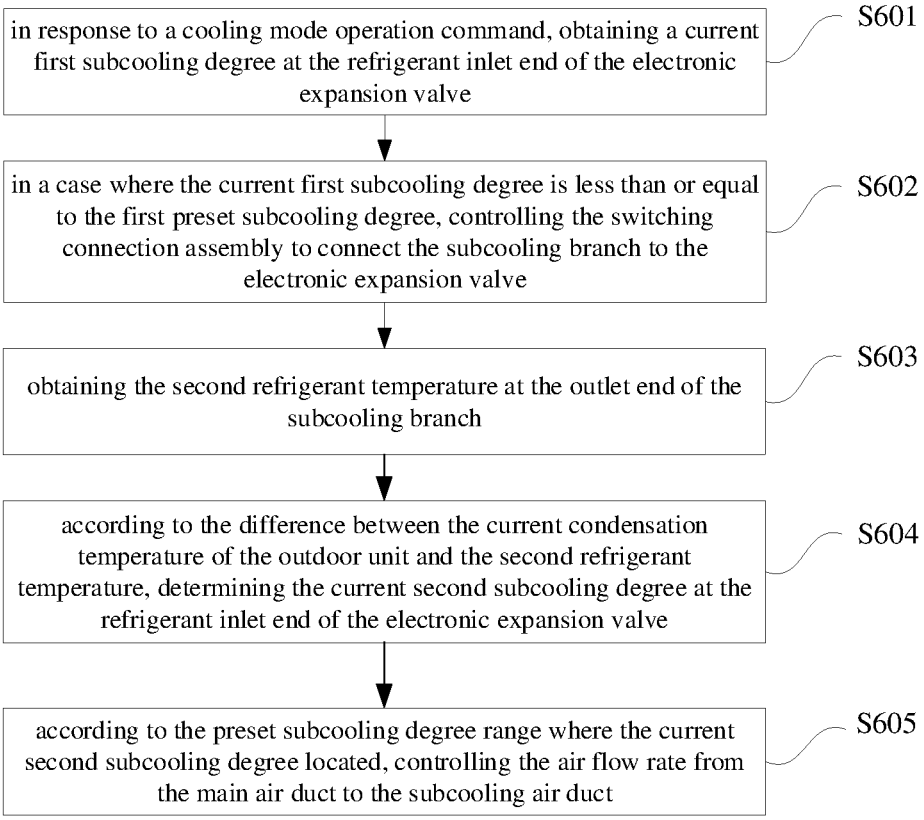
FIG. 6 is a flow chart of another method for controlling the multi-split air conditioner provided by the embodiment of the present disclosure.

FIG. 6 is a flow chart of the method for controlling the multi-split air conditioner provided by the embodiment of the present disclosure, which is adapted to the multi-split air conditioner shown in FIG. 2, and the indoor unit comprises a main air duct and a subcooling air duct. The method can be executed by a processor of the multi-split air conditioner or in a cloud server communicated with the multi-split air conditioner. It can further be executed at the control terminal of the multi-split air conditioner. In the embodiment, the disclosure is explained by taking the processor of the multi-split air conditioner as the executive subject.

As shown in FIG. 6, the method for controlling the multi-split air conditioner comprises:

S601, in response to a cooling mode operation command, obtaining a current first subcooling degree at the refrigerant inlet end of the electronic expansion valve;

S602, in a case where the current first subcooling degree is less than or equal to the first preset subcooling degree, controlling the switching connection assembly to connect the subcooling branch to the electronic expansion valve;

S603, obtaining the second refrigerant temperature at the outlet end of the subcooling branch;

S604, according to the difference between the current condensation temperature of the outdoor unit and the second refrigerant temperature, determining the current second subcooling degree at the refrigerant inlet end of the electronic expansion valve; and

S605, according to the preset subcooling degree range where the current second subcooling degree located, controlling the air flow rate from the main air duct to the subcooling air duct.

Herein, by controlling the air flow from the main air duct to the subcooling air duct, the air flow from the subcooling air duct exchanges heat with the subcooler, thus increasing the subcooling degree of the refrigerant in the subcooler.

The second refrigerant temperature can be the refrigerant temperature at the outlet end of the subcooler of the subcooling branch or the refrigerant temperature at the outlet end of the pipeline of the subcooling branch.

The current second subcooling degree refers to the subcooling degree before the electronic expansion valve at the current time, in a case where part or all the refrigerant enters the electronic expansion valve after passing through the subcooling branch.

Further, the current second subcooling degree can be obtained by:

$$SC_{j2} = k \times TC - T_{l,j2}$$

where $SC_{j2}$ is the current second subcooling degree, TC is the current condensation temperature, $T_{1,j2}$ is the second refrigerant temperature, k is a subcooling correction parameter, and k<1.

Optionally, the step of, according to the preset subcooling degree range where the current second subcooling degree is located, controlling the air flow rate from the main air duct to the subcooling air duct comprises:

in a case where the current second subcooling degree is less than or equal to the first preset subcooling degree, controlling the air flow rate from the main air duct to the subcooling air duct to increase;

in a case where the current second subcooling degree is greater than the second preset subcooling degree, controlling the air flow rate from the main air duct to the subcooling air duct to decrease; or in a case where the current second subcooling degree is greater than the first preset subcooling degree and less than or equal to the second preset subcooling degree, controlling the air flow rate from the main air duct to the subcooling air duct to remain unchanged.

Herein, according to different preset subcooling degree range where the current second subcooling degree is located, the air flow rate from the main air duct to the subcooling air duct is adjusted, so that the second subcooling degree is kept in an appropriate range, and no obvious throttling sound will occur during throttling.

The second preset subcooling degree $n_2$ is employed to indicate that the current subcooling degree is large, and there will be noise problems when the refrigerant flows through the electronic expansion valve, so it is necessary to reduce the subcooling degree.

That is, by controlling the air flow rate from the main air duct to the subcooling air duct, the second subcooling degree is maintained within the range of $(n_1, n_2]$ (i.e., the appropriate subcooling degree range), the purpose of improving the abnormal throttling sound has been achieved.

The values of the appropriate subcooling degree range are determined according to the environment temperature parameters and/or the caliber parameters of the electronic expansion valve. The environment temperature parameters comprise the outdoor environment temperature and the indoor environment temperature. By way of example, the larger the caliber parameter of the electronic expansion valve, the smaller the values of the lower and upper limits of the appropriate subcooling degree range. Optionally, the corresponding relationship between environment temperature parameters, electronic expansion valve caliber parameters, and appropriate subcooling degree range can be obtained by means of experiments. After obtaining the current environment temperature parameter and/or the caliber parameter of the electronic expansion valve, the current appropriate subcooling degree range corresponding to the current environment temperature parameter and/or the caliber parameter of the electronic expansion valve can be obtained by inquiring the database, thereby controlling the air flow from the main air duct to the subcooling air duct according to the numerical relationship between the current second subcooling degree and the current appropriate subcooling degree range.

Optionally, after controlling the air flow rate from the main air duct to the subcooling air duct, the method further comprises:

according to a preset duration, obtaining the second refrigerant temperature and the condensation temperature at the outlet end of the subcooling branch at intervals.

That is, the preset duration is defined as an adjustment duration to adjust the air flow rate entering the subcooling air duct at intervals in a case where the main air duct is connected to the subcooling air duct, so that the subcooling degree before the valve determined according to the second refrigerant temperature and the condensation temperature is maintained within the appropriate subcooling degree range.

Further, the air flow rate from the main air duct to the subcooling air duct is adjusted by adjusting the opening degree of the damper provided on the subcooling air duct.

With reference to FIG. 4, the step of controlling the air flow rate from the main air duct to the subcooling air duct to increase can comprise: controlling the stepper motor to drive the damper to rotate in the direction of increasing the opening degree.

Further, the step of controlling the stepper motor to drive the damper to rotate in the direction of increasing the opening degree can comprise:

obtaining the current subcooling difference value between $SC_{j2}$ and $n_1$, and determining the corresponding current opening degree adjustment value according to the difference value range where the current subcooling difference value located;

according to the corresponding relationship between the opening degree adjustment value and the step number of the stepper motor, determining the current driving step number of the stepper motor; and controlling the stepper motor to run according to the current driving step number, so as to control the damper to rotate according to the current opening degree adjustment value.

In this way, it is possible to control the damper rotation value in real-time according to $SC_{j2}$, so that the air flow rate from the main air duct to the subcooling air duct can meet the demand of improving the subcooling degree.

By the same token, further, the step of controlling the stepper motor to drive the damper to rotate in the direction of decreasing the opening degree can comprise:

obtaining the current subcooling difference value between $SC_{j2}$ and $n_2$, and determining the corresponding current opening degree adjustment value according to the difference value range where the current subcooling difference value located;

according to the corresponding relationship between the opening degree adjustment value and the step number of the stepper motor, determining the current driving step number of the stepper motor;

controlling the stepper motor to run according to the current driving step, so as to control the damper to rotate according to the current opening degree adjustment value.

In this way, the damper rotation value can be controlled in real-time according to $SC_{j2}$, and the air flow rate entering the subcooling air duct can be reduced, thereby avoiding the occurrence of excessive subcooling.

Figure 7:
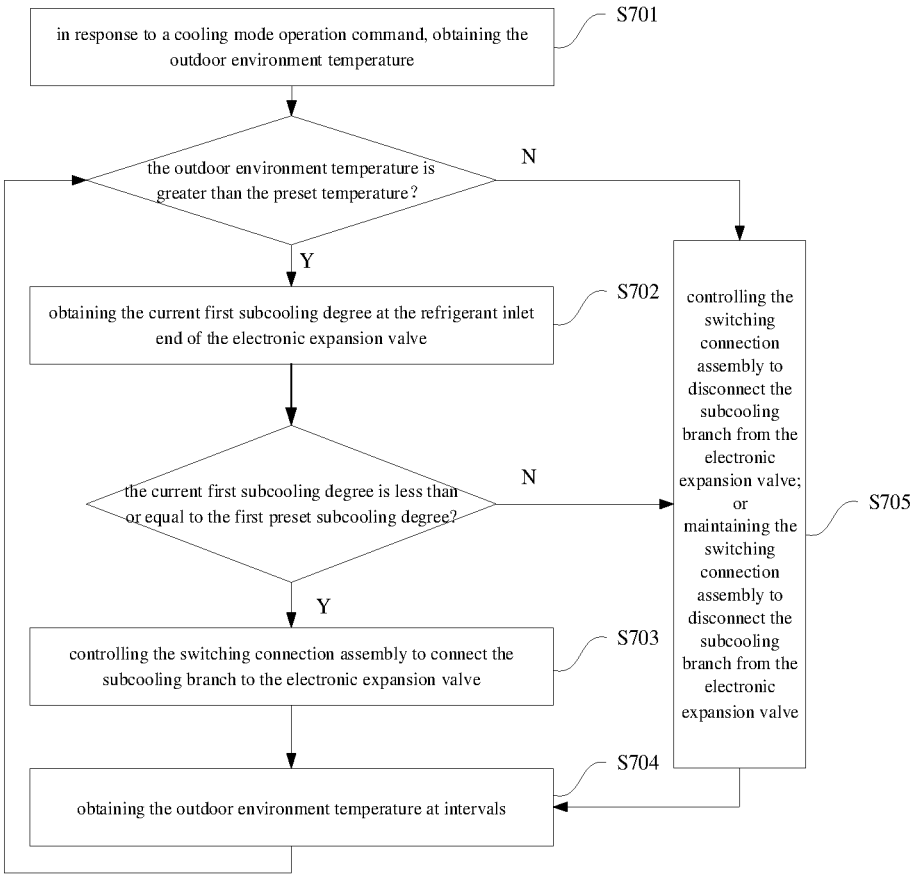
FIG. 7 is a flow chart of another method for controlling the multi-split air conditioner provided by the embodiment of the present disclosure.

FIG. 7 is a flow chart of a method for controlling the multi-split air conditioner provided by an embodiment of the present disclosure, which is adapted to the multi-split air conditioner shown in FIG. 2. The method can be executed by a processor of the multi-split air conditioner or in a cloud server communicated with the multi-split air conditioner. It can further be executed at the control terminal of the multi-split air conditioner. In the embodiment, the disclosure is explained by taking the processor of the multi-split air conditioner as the executive body.

As shown in FIG. 7, the method for controlling the multi-split air conditioner comprises:

S701, in response to a cooling mode operation command, obtaining the outdoor environment temperature;

S702, in a case where the outdoor environment temperature is greater than the preset temperature, obtaining the current first subcooling degree at the refrigerant inlet end of the electronic expansion valve;

S703, in a case where the current first subcooling degree is less than or equal to the first preset subcooling degree, controlling the switching connection assembly to connect the subcooling branch to the electronic expansion valve;

S704, obtaining the outdoor environment temperature at intervals; and

S705, in a case where the outdoor environment temperature is less than or equal to the preset temperature, controlling the switching connection assembly to disconnect the subcooling branch from the electronic expansion valve; and in a case where the current first subcooling degree is greater than the first preset subcooling degree, controlling the switching connection assembly to disconnect the subcooling branch from the electronic expansion valve, or maintaining the switching connection assembly to disconnect the subcooling branch from the electronic expansion valve.

The outdoor environment temperature is greater than the preset temperature, which indicates that the outdoor environment temperature is high, which may affect the refrigerant temperature of the pipes from the outdoor unit to the indoor unit, resulting in insufficient subcooling before the valve. The preset temperature can be 26° C.-30° C., for example, 26° C., 27° C., 28° C., 29° C. and 30° C. In the embodiment, the preset temperature is set to 27° C.

In a case where the outdoor environment temperature is greater than the preset temperature, the operation of obtaining the subcooling degree before the valve is triggered, and then the values of the current first subcooling degree at the refrigerant inlet end of the electronic expansion valve and the first preset subcooling degree is employed to determine whether it is necessary to increase the subcooling degree before the valve by connecting the subcooling branch, so as to achieve the purpose of improving the abnormal noise of throttling sound.

In a case where the outdoor environment temperature is less than or equal to the preset temperature, which indicates that the outdoor environment temperature has little influence on the refrigerant temperature of the pipes from the outdoor unit to the indoor unit, and the possibility of insufficient subcooling before the valve is reduced. In this case, the connection relationship between the subcooling branch and the electronic expansion valve is disconnected, so that the refrigerant directly enters the electronic expansion valve through the main flow path.

In this way, with the subcooling parallel section before the refrigerant inlet end of the electronic expansion valve of the indoor unit of the multi-split air conditioner and the subcooling branch disposed in parallel with the subcooling parallel section, the subcooling degree before the electronic expansion valve is obtained in a case the outdoor environment temperature is greater than the preset temperature, and under the condition that the subcooling degree before the valve is insufficient, the switching connection assembly is controlled and switched to realize that part or all the refrigerant flow in the main flow path of the indoor unit enters the refrigerant inlet end of the electronic expansion valve after passing through the subcooling branch, so as to improve the subcooling degree before the electronic expansion valve and further make the refrigerant in the throttling process more stable. And in a case the outdoor environment temperature is less than or equal to the preset temperature, the refrigerant circulation of the main flow path is restored. By applying the method for controlling the multi-split air conditioner provided by the embodiment, the purpose of improving the abnormal throttle sound at the indoor side of the multi-split air conditioner can be achieved.

Figure 8:
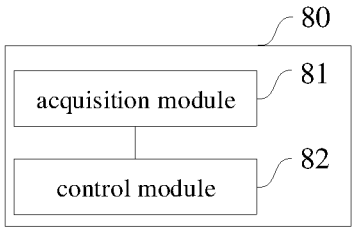
FIG. 8 is a schematic diagram of a device for controlling the multi-split air conditioner provided by the embodiment of the present disclosure.

FIG. 8 is a schematic diagram of a device for controlling the multi-split air conditioner provided by the embodiment of the present disclosure. The device for controlling the multi-split air conditioner can be realized by software, hardware, or a combination of the two.

In some embodiments, the device 80 for controlling a multi-split air conditioner comprises an acquisition module 81 and a control module 82, where the acquisition module 81 configured to, in response to a cooling mode operation command, obtain a current first subcooling degree at a refrigerant inlet end of an electronic expansion valve; and the control module 82 configured to, in a case where the current first subcooling degree is less than or equal to a first preset subcooling degree, control a switching connection assembly to connect a subcooling branch with the electronic expansion valve.

Figure 9:
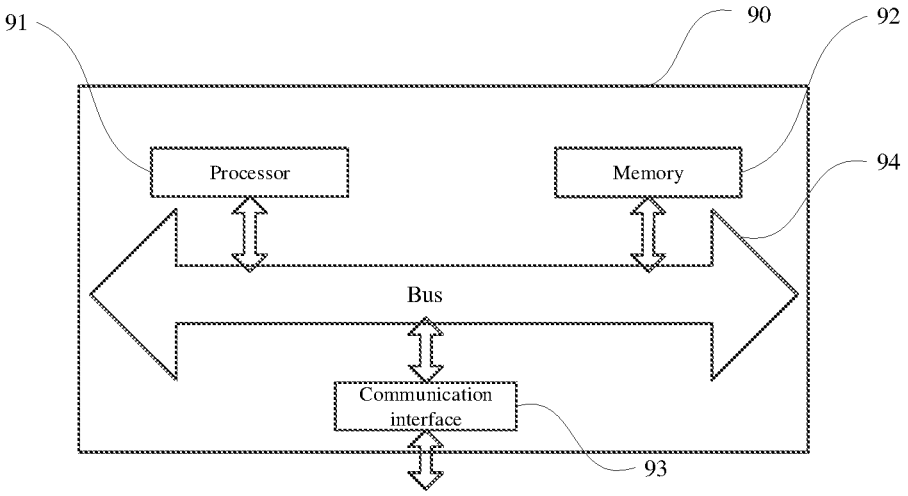
FIG. 9 is a schematic diagram of another device for controlling the multi-split air conditioner provided by the embodiment of the present disclosure.

FIG. 9 is a schematic diagram of a device for controlling the multi-split air conditioner provided by the embodiment of the present disclosure. As shown in FIG. 9, the device 90 for controlling the multi-split air conditioner comprises:

a processor 91 and a memory 92. Optionally the device can further comprise a communication interface 93 and a bus 94. The processor 91, the communication interface 93, and the memory 92 can communicate with each other via the bus 94. The communication interface 93 may be used for information transmission. The processor 91 may invoke logic instructions in memory 92 to execute the method for controlling the multi-split air conditioner of the above embodiments.

Further, the logic instructions in the memory 92 described above may be realized in the form of software functional units and may be stored in a computer-readable storage medium when sold or used as a separate product.

The memory 92 as a computer-readable storage medium may be used to store software programs and computer-executable programs such as program instructions/modules corresponding to the methods in embodiments of the present disclosure. The processor 91 executes functional disclosures as well as data processing by running program instructions/modules stored in the memory 92 that is to implement the method for controlling the multi-split air conditioner in the above-described embodiments.

The memory 92 may comprise a stored program area and a stored data area wherein the stored program area may store an operating system or a disclosure program required for at least one function. The storage data area may store data created according to the use of the terminal device. In addition the memory 92 may comprise a high-speed random access memory and can further comprise a non-volatile memory.

The embodiments of the present disclosure provide a multi-split air conditioner comprising the device 80 (90) for controlling the multi-split air conditioner described above.

The embodiments of the present disclosure provide a computer-readable storage medium storing computer-executable instructions configured to execute the method for controlling the multi-split air conditioner.

The embodiments of the present disclosure provide a computer program that, when executed by a computer, causes the computer to implement the method for controlling a multi-split air conditioner.

The embodiments of the present disclosure provide a computer program product comprising a computer program stored on a computer-readable storage medium, the computer program comprising program instructions that, when executed by a computer, cause the computer to execute the above-described method for controlling the multi-split air conditioner.

The computer-readable storage medium may be a transitory computer-readable storage medium or a non-transitory computer-readable storage medium.

The technical solution of the disclosed embodiments may be embodied in the form of a software product stored in a storage medium, comprising one or more instructions for causing a computer device (which may be a personal computer, server, or network device, etc.) to perform all or part of the steps of the method of the disclosed embodiments. The aforementioned storage medium may be a non-transient storage medium, comprising a USB disk, a mobile hard disk, a Read-Only Memory (ROM), a Random Access Memory (RAM), a magnetic disk or an optical disk, and other media capable of storing program codes, or may be a transient storage medium.

The above description and drawings sufficiently illustrate embodiments of the present disclosure to enable those skilled in the art to practice them. Other embodiments may comprise structural logical electrical procedural and other changes. The embodiments represent only possible variations. Unless explicitly required, individual parts and functions are optional, and the order of operation can vary. Portions and features of some embodiments may be comprised in or in place of portions and features of other embodiments. Furthermore the terms used in the present disclosure are used only to describe embodiments and are not used to limit the claims. As used in the embodiments and in the description of the claims, the singular forms of "a", "an" and "the" are intended to comprise the plural forms as well, unless the context clearly indicates. Similarly, the term "and/or" as used in this disclosure means encompassing one or more associated lists of any and all possible combinations. Additionally, when used in this disclosure, the term "comprise" and its variants "comprises" and/or "comprising", etc. refer to the presence of stated features, totals, steps, operations, elements, and/or components, but do not exclude the presence or addition of one or more other features, totals, steps, operations, elements, components, and/or groupings of these. In the absence of further limitations, an element defined by the phrase "comprises a/an . . . " does not preclude the existence of another identical element in the process, method or apparatus in which the element is comprised. Herein each embodiment may be highlighted as being different from the other embodiments and the same similar parts between the various embodiments may be referred to with respect to each other. For the method, product, etc. disclosed by the embodiment, if it corresponds to the method portion disclosed by the embodiment, reference can be made to the description of the method portion where relevant.

Those skilled in the art will appreciate that the various example units and algorithm steps described in connection with the embodiments disclosed herein can be implemented in electronic hardware or a combination of computer software and electronic hardware. Whether these functions are performed in hardware or software can depend on the specific disclosure and design constraints of the technical solution. One skilled in the art may use different methods for each particular disclosure to implement the described functionality but such implementation should not be considered outside the scope of the disclosed embodiments. It will be apparent to the person skilled in the art that for convenience and conciseness of description, the specific operating processes of the above-described systems, apparatuses and units may be referred to the corresponding processes in the aforementioned method embodiments and will not be repeated herein.

In the embodiments disclosed herein, the disclosed methods, products (comprising but not limited to devices, apparatus, etc.) may be implemented in other ways. For example, the above-described embodiment of the apparatus is only schematic, for example, the division of the unit may be only a logical function division, and in practice there may be another division mode, for example, multiple units or components may be combined or integrated into another system, or some features may be ignored or not performed. In addition, the coupling or direct coupling or communication connection between each other shown or discussed may be indirect coupling or communication connection through some interface, device or unit, and may be electrical, mechanical or other form. The elements illustrated as separate elements may or cannot be physically separated, and the elements displayed as elements may or cannot be physical elements, i.e. may be located in one place, or may be distributed over a plurality of network elements. Some or all of the units can be selected according to actual needs to realize the embodiment. In addition, each functional unit in the embodiment of the present disclosure may be integrated in one processing unit, each unit may exist physically alone, or two or more units may be integrated in one unit.

The flow charts and block diagrams in the accompanying drawings illustrate the architecture functionality and operation of possible implementations of systems methods and computer program products according to embodiments of the present disclosure. In this regard, each block in a flow chart or block diagram may represent a module, program segment, or part of code containing one or more executable instructions for performing a specified logical function. In some alternative implementations the functions indicated in the boxes may further occur in a different order than those indicated in the drawings. For example, two successive boxes can actually be executed substantially in parallel, or they can sometimes be executed in reverse order, depending on the functionality involved. In the description corresponding to the flowcharts and block diagrams in the drawings, the operations or steps corresponding to different blocks may further occur in a different order than that disclosed in the description, and sometimes there is no specific order between the different operations or steps. For example, two successive operations or steps can actually be performed substantially in parallel, or they can sometimes be performed in reverse order, depending on the functionality involved. Each block in the block diagram and/or flow chart, and a combination of the blocks in the block diagram and/or flow chart, may be implemented in a dedicated hardware-based system that performs a specified function or action, or may be implemented in a combination of dedicated hardware and computer instructions.

The invention claimed is:

1. A multi-split air conditioner, comprising an outdoor unit and an indoor unit group, wherein the indoor unit comprises a plurality of indoor units connected in parallel, and at least one indoor unit comprises:

a main flow path comprising a main pipeline, an electronic expansion valve and an indoor heat exchanger connected sequentially through the main pipeline, wherein at least part of the main pipeline located at a refrigerant inlet end of the electronic expansion valve is defined as a subcooling parallel section;

a subcooling branch comprising a subcooler and connected in parallel with the subcooling parallel section; and a switching connection assembly configured to be controlled to connect at least one of the subcooling parallel section and the subcooling branch with the electronic expansion valve;

wherein the indoor unit further comprises:

a main air duct provided with an indoor heat exchanger; and a subcooling air duct disposed at a downstream air path of the main air duct and connected in series with the main air duct, wherein the subcooler is disposed in the subcooling air duct, and an air inlet of the subcooling air duct is further provided with a damper configured to be controlled to adjust an opening degree of the air inlet of the subcooling air duct to change the air flow rate flowing through the subcooling air duct from the main air duct.

2. The multi-split air conditioner according to claim 1, wherein the subcooler is disposed at a wind area of an air outlet side of the indoor heat exchanger.

3. The multi-split air conditioner according to claim 1, wherein the switching connection assembly comprises:

a first solenoid valve disposed at the subcooling parallel section; and a second solenoid valve disposed at the subcooling branch.

4. A method for controlling a multi-split air conditioner comprising an outdoor unit and an indoor unit group, wherein the indoor unit comprises a plurality of indoor units connected in parallel, and at least one indoor unit comprises: a main flow path comprising a main pipeline, an electronic expansion valve and an indoor heat exchanger connected sequentially through the main pipeline, wherein at least part of the main pipeline located at a refrigerant inlet end of the electronic expansion valve is defined as an subcooling parallel section; a subcooling branch comprising a subcooler and connected in parallel with the subcooling parallel section; and a switching connection assembly configured to be controlled to connect at least one of the subcooling parallel section and the subcooling branch with the electronic expansion valve, comprising:

in response to a cooling mode operation command, obtaining a current first subcooling degree at the refrigerant inlet end of the electronic expansion valve; and in a case where the current first subcooling degree is less than or equal to the first preset subcooling degree, controlling the switching connection assembly to connect the subcooling branch to the electronic expansion valve.

5. The method according to claim 4, wherein the step of obtaining a current first subcooling at the refrigerant inlet end of the electronic expansion valve comprises:

according to a difference between a current condensation temperature of the outdoor unit and a first refrigerant temperature at the refrigerant inlet end of the electronic expansion valve, determining the current first subcooling degree.

6. The method according to claim 5, wherein the current first subcooling degree is obtained by:

$$SC_{j1} = k \times TC - T_{1,j1}$$

wherein $SC_{j1}$ is the current first subcooling degree, TC is the current condensation temperature, $T_{1,j1}$ is the first refrigerant temperature, k is a subcooling correction parameter, and k<1.

7. The method according to claim 4, wherein the step of controlling the switching connection assembly to connect the subcooling branch to the electronic expansion valve comprises:

controlling the switching connection assembly to connect the subcooling branch to the electronic expansion valve and to disconnect the subcooling parallel section from the electronic expansion valve.

8. The method according to claim 4, wherein the indoor unit comprises a main air duct and a subcooling air duct, and after controlling the switching connection assembly to connect the subcooling branch to the electronic expansion valve, the method further comprises:

obtaining a second refrigerant temperature at an outlet end of the subcooling branch;

according to a difference between the current condensation temperature of the outdoor unit and the second refrigerant temperature, determining the current second subcooling degree at the refrigerant inlet end of the electronic expansion valve; and according to the preset subcooling degree range where the current second subcooling degree located, controlling the air flow rate from the main air duct to the subcooling air duct.

9. The method according to claim 8, wherein the current second subcooling is obtained by:

$$SC_{j2} = k \times TC - T_{l,j2}$$

wherein $SC_{j2}$ is the current second subcooling degree, TC is the current condensation temperature, $T_{1,j2}$ is the second refrigerant temperature, k is a subcooling correction parameter, and k<1.

10. The method according to claim 8, wherein the step of controlling the air flow rate from the main air duct to the subcooling air duct comprises:

in a case where the current second subcooling degree is less than or equal to the first preset subcooling degree, controlling the air flow rate from the main air duct to the subcooling air duct to increase.

11. The method according to claim 10, wherein in a case where a damper is provided on the subcooling air duct, for controlling an opening degree of the air inlet of the subcooling air duct to change the air flow rate flowing through the subcooling air duct from the main air duct; and the step of controlling the air flow rate from the main air duct to the subcooling air duct to increase comprises:

according to a difference between the current second subcooling degree and the first preset subcooling degree, controlling the damper to rotate in the direction of increasing the opening degree, so as to increase the air flow rate from the main air duct to the subcooling air duct.

12. The method according to claim 4, further comprising:

in a case where an outdoor environment temperature is greater than the preset temperature, obtaining the current first subcooling degree at the refrigerant inlet end of the electronic expansion valve.

13. The method according to claim 4, wherein the step of controlling the switching connection assembly to connect the subcooling branch to the electronic expansion valve comprises:

controlling the switching connection assembly to connect the subcooling branch and the subcooling parallel section to the electronic expansion valve.

14. The method according to claim 8, wherein the step of controlling the air flow rate from the main air duct to the subcooling air duct comprises:

in a case where the current second subcooling degree is greater than the second preset subcooling degree, controlling the air flow rate from the main air duct to the subcooling air duct to decrease.

15. The method according to claim 8, wherein the step of controlling the air flow rate from the main air duct to the subcooling air duct comprises:

in a case where the current second subcooling degree is greater than the first preset subcooling degree and less than or equal to the second preset subcooling degree, controlling the air flow rate from the main air duct to the subcooling air duct to remain unchanged.

16. The method according to claim 14, wherein in a case where a damper is provided on the subcooling air duct, for controlling an opening degree of the air inlet of the subcooling air duct to change the air flow rate flowing through the subcooling air duct from the main air duct; and the step of controlling the air flow rate from the main air duct to the subcooling air duct to decrease comprises:

according to the difference between the current second subcooling degree and the second preset subcooling degree, controlling the damper to rotate in the direction of decreasing the opening degree, so as to decrease the air flow rate from the main air duct to the subcooling air duct.

* * * * *